United States Patent [19]

Kamberg

[11] 4,299,555

[45] Nov. 10, 1981

[54] CONTROL CIRCUIT FOR COMBUSTION SYSTEMS

[75] Inventor: Eduard Kamberg, Chicago, Ill.

[73] Assignee: New Super Laundry Machine Co., Chicago, Ill.

[21] Appl. No.: 34,241

[22] Filed: Apr. 30, 1979

[51] Int. Cl.[3] ..... F23N 3/00

[52] U.S. Cl. ..... 431/20; 431/31

[58] Field of Search ..... 431/20, 30, 31

[56] References Cited

U.S. PATENT DOCUMENTS

| | | | |
|---|---|---|---|
| 2,155,642 | 4/1939 | Dewey | 431/20 |
| 2,259,299 | 10/1941 | Dewey | 431/30 |
| 3,650,262 | 3/1972 | Root et al. | 431/20 |

*Primary Examiner*—Carroll B. Dority, Jr.

*Attorney, Agent, or Firm*—Edward C. Threedy

[57] ABSTRACT

A control circuit for gas fired burners and the like such as are employed in commercial laundry fabric ironers requiring the energization of a blower motor and the resulting opening of a gas valve and ignition of a gas burner only after an air pressure sensitive switch is actuated through the operation of the blower motor for purging the system of combustible gases.

4 Claims, 1 Drawing Figure

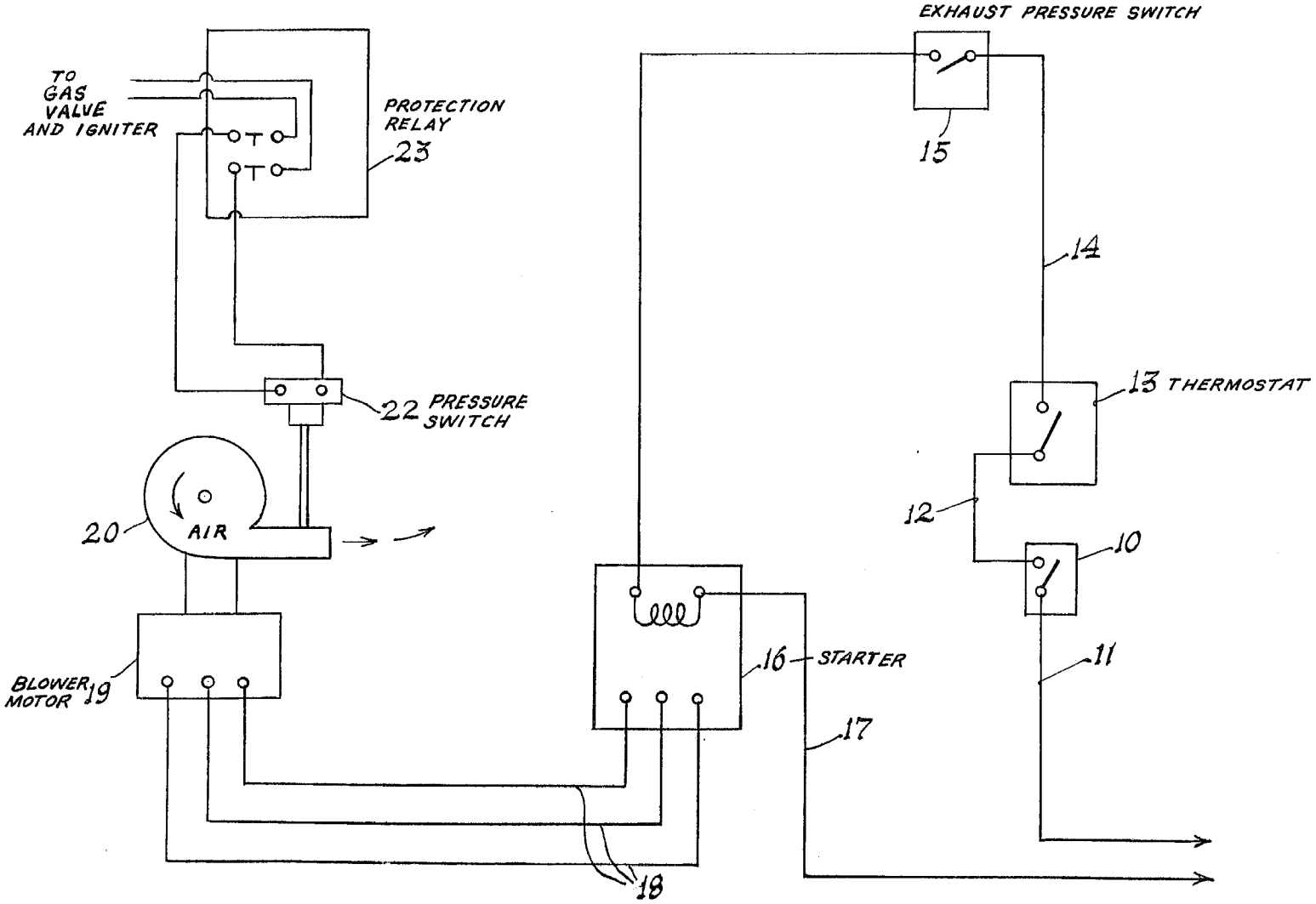
EXHAUST PRESSURE SWITCH
15
14
13 THERMOSTAT
12
10
11
STARTER
16
17
18
PROTECTION RELAY
23
22 PRESSURE SWITCH
AIR
20
BLOWER MOTOR 19
TO GAS VALVE AND IGNITER

CONTROL CIRCUIT FOR COMBUSTION SYSTEMS

SUMMARY OF THE INVENTION

The prior art relating to control circuits for gas fired burners and the like are high energy consuming apparatuses. That is to say, that the prior systems energize and maintain the operation of the blower motor irregardless of the requirement for ignition and air circulation.

It is an object of the present invention to provide a circuit in which the blower motor operates only in response to a thermostatic setting. Notwithstanding the controlled operation of the blower motor there is a pre-purging as well as post-purging of combustible material throughout the system.

Also, by controlling the operation of the blower motor, the device is not cooled during an interrupted operation, as would result if, as in the prior devices, the blower motor remained energized at all times irregardless of ignition.

To accomplish the object of this invention there is provided a circuit, which includes a set of switch components connected in series and responsive to different conditions of the system before ignition can be achieved.

BRIEF DESCRIPTION OF THE DRAWING

The object of this invention is achieved through the circuitry illustrated in which:

FIG. 1 is a schematic diagram of the controlled ignition circuitry for a combustion system.

GENERAL DESCRIPTION

The schematic wiring diagram of FIG. 1 is illustrative of the circuitry employed effecting the desired control of the electrical ignition system of the invention.

A gas on-off switch 10 is in one line 11 of a 24 v. bus line.

By a line 12 the switch 10 is connected in series with a thermostat 13. The closed switch portion of thermostat 13 is, by line 14, connected to a pressure switch 15, located in the exhaust canopy (not shown). This switch 15 is connected in series with the on-off switch 10 and thermostat 13 and is adapted to be actuated in response to the pressure created by the energization and operation of an exhaust fan (not shown).

A magnetic starter 16 is next connected in series with the aforementioned switches, and by line 17 connected to the remaining bus line of the 24 v. supply.

By a triple line cable 18 the starter 16 is connected to the blower motor 19.

A pressure switch 22 is actuated by the operation of the combustion blower 20, and in turn actuates a protection relay 23 of the type which is commercially available under Model No. RA890F from the Honeywell Company.

The protection relay 23 in turn will operate a gas valve (not shown) and energizes a spark ignition (not shown). These latter components are included in the controlled device, such as a commercial flat ironer, and as such make up no part of the present invention other than in total environment.

The operation of the circuit and its components as hereinbefore described is as follows:

The circuit is conditioned for energization by the closing of the gas on-off switch 10. At this point in time, if the setting of the thermostat 13 requires the gas valve to be opened and ignited, the thermostat switch 13 will be closed.

The combustion blower 20 will commence an air flow through and over the gas burner unit which, however, will remain inoperative until the pressure sensitive switch 22 closes, at which time the protection relay 23 will be energized to open the gas valve and cause ignition of the same.

The initial operation of the combustion blower 20 causes air to be introduced into the burner for a period of time adequately to post-purge the same after the thermostat switch 13 has opened and de-energized the system.

From the foregoing, it is apparent that the control system functions to purge both post and pre-combustion. The The aforedescribed circuitry saves energy through its controlled operation and, in addition, does not dissipate the heat of the device to which it is associated when heat is not required. The only time the combustion system is in operation is when the thermostat requires heat to be supplied to the device.

While I have illustrated and described the preferred form of construction for carrying my invention into effect, this is capable of variation and modification without departing from the spirit of the invention. I, therefore, do not wish to be limited the precise details of construction as set forth, but desire to avail myself of such variations and modifications as come within the scope of the appended claims.

Having thus described my invention what I claim as new and desire to protect by Letters Patent is:

1. In a combustion control assembly having a burner supplied with combustible gases from a control valve, an ignition system, and an exhaust system therefor comprising:

(a) an electric circuit including a voltage supply source, (b) a starter switch and thermostat connected in series in said circuit, (c) a starter means connected in series with said switches and said voltage supply source, (d) means connected in series with said switches and said starter means and responsive to the operation of the exhaust system for completing the circuit to said starter means, (e) a blower having a motor in circuit with said starter means and operatively responsive to its energization, and (f) means responsive to the operation of said blower for energizing a protective relay adapted to open the control valve only during the period of energization of said exhaust system and said blower motor.

2. In a combustion control assembly as defined by claim 1 wherein said means connected in series with said switches and responsive to the operation of the exhaust system comprises a pressure sensitive switch.

3. In a combustion control assembly as defined by claim 1 wherein said means responsive to the operation of said blower motor comprises a pressure sensitive switch adapted to energize the protective relay only during the period of energization of said blower motor.

4. In a combustion control assembly as defined by claim 3 wherein said means in series with said switches and responsive to the operation of the exhaust system comprises a pressure sensitive switch.

* * * * *